US007631761B2

(12) United States Patent
Gradzewicz

(10) Patent No.: US 7,631,761 B2
(45) Date of Patent: Dec. 15, 2009

(54) WARMING CONTAINER FOR WIPES

(75) Inventor: Lisa M Gradzewicz, Old Saybrook, CT (US)

(73) Assignee: LMG Enterprises, LLC, Pld Saybrook, CT (US)

( * ) Notice: Subject to any disclaimer, the term of this patent is extended or adjusted under 35 U.S.C. 154(b) by 153 days.

(21) Appl. No.: 11/692,474

(22) Filed: Mar. 28, 2007

(65) Prior Publication Data

US 2008/0128432 A1 Jun. 5, 2008

Related U.S. Application Data

(63) Continuation-in-part of application No. 11/565,898, filed on Dec. 1, 2006.

(51) Int. Cl.
*B65D 85/48* (2006.01)
*A47J 39/00* (2006.01)
*F24J 1/00* (2006.01)

(52) U.S. Cl. ..... 206/449; 220/592.01; 126/263.01

(58) Field of Classification Search ..... 206/494, 206/210, 233, 812, 524.4, 823, 581, 216, 206/541, 545; 219/386; 220/503–505, 523, 220/524, 553, 554, 810, 592.01; 126/263.01
See application file for complete search history.

(56) References Cited

U.S. PATENT DOCUMENTS

| | | | | |
|---|---|---|---|---|
| 4,943,705 | A | 7/1990 | Halloran | |
| 5,004,894 | A | 4/1991 | Whitehead | |
| 5,210,396 | A | 5/1993 | Sanders | |
| 5,465,888 | A | 11/1995 | Owens | |
| 5,738,082 | A * | 4/1998 | Page et al. | 126/263.01 |
| 6,062,381 | A | 5/2000 | Paley et al. | |
| 6,092,519 | A * | 7/2000 | Fish et al. | 126/263.01 |
| 6,164,442 | A * | 12/2000 | Stravitz | 206/233 |
| 6,427,839 | B1 * | 8/2002 | Helfer-Grand | 206/494 |
| D469,288 | S | 1/2003 | Wray et al. | |
| 6,540,084 | B2 * | 4/2003 | Silvers | 206/581 |
| 6,875,604 | B2 | 4/2005 | Shin et al. | |
| 6,878,032 | B1 * | 4/2005 | Paquette | 446/207 |
| 6,886,553 | B2 | 5/2005 | Yim | |
| 7,022,945 | B1 | 4/2006 | Western | |
| 7,124,883 | B1 * | 10/2006 | Thomas et al. | 206/256 |

(Continued)

FOREIGN PATENT DOCUMENTS

EP 119314 A2 * 9/1984

*Primary Examiner*—Mickey Yu
*Assistant Examiner*—Melissa L Lalli
(74) *Attorney, Agent, or Firm*—DeLio & Peterson LLC; Peter W. Peterson

(57) ABSTRACT

A container for supplying warm wipes having a compartment for holding a plurality of wipes and at least one pocket for holding a chemical heat pack. The pocket has a first surface in thermal contact with the compartment holding the wipes and a second surface having at least one opening in direct contact with the atmospheric air. The opening is of sufficient size to permit atmospheric air to circulate to the chemical heat pack in the pocket and cause an exothermic heat reaction to occur within the chemical heat pack and warm the wipes by transmitting heat through the pocket first surface. In place of having an opening, the second surface of the pocket may be a flexible, porous surface to permit atmospheric air to circulate to the chemical heat pack in the pocket through the pores in the second surface.

4 Claims, 13 Drawing Sheets

U.S. PATENT DOCUMENTS

2001/0035416 A1* 11/2001 Dodson ..... 220/524
2001/0037872 A1 11/2001 Sabin et al.
2002/0083840 A1 7/2002 Lassota
2004/0089578 A1* 5/2004 Lin ..... 206/494
2004/0112367 A1* 6/2004 Zaninelli ..... 126/263.07
2005/0127087 A1 6/2005 Clark et al.
2005/0224388 A1 10/2005 Saric et al.

* cited by examiner

WARMING CONTAINER FOR WIPES

RELATED APPLICATION

This is a continuation in part of U.S. Ser. No. 11/565,898 filed on Dec. 1, 2006.

BACKGROUND OF THE INVENTION

1. Field of the Invention

The present invention relates to a container used to store, warm to above ambient temperatures and dispense moistened sheets of paper or cloth disposable wipes for personal use.

2. Description of Related Art

With a typical moistened wipe in a prepackaged container, the wipe usually contains a solution which has some evaporative qualities and upon contact with the air outside the container, the wipe will immediately and continually tend to drop in temperature until it contacts the skin. Upon contact with the skin, the wipe creates a cool sensation on the skin both from transfer of heat from the skin to the wipe and from the evaporation of the solution from the skin once the wipe has transferred a quantity of the solution onto the skin. This is of more particular concern when the situation involves using a wipe on an infant. The surprise of the cooler sensation often times is evident from various reactions of the infant. Some caretakers have found it less stressful on the infant by first applying the wipe to their own skin in order to increase the temperature of the wipe, but this can be both a contamination source and a consumption of time in a process in which both the caretaker and infant would prefer to minimize.

There have been several attempts to address this problem, for example in U.S. Pat. Nos. 4,943,705, 5,004,894, 5,738,082, and 7,022,945. Even where such prior art employs a chemical heat source, there have been deficiencies in performance and heating of wipes using the disclosed containers. They in general have not been economical or simple to use, and do not provide optimum performance from the chemical heat source.

SUMMARY OF THE INVENTION

Bearing in mind the problems and deficiencies of the prior art, it is therefore an object of the present invention to provide a container for supplying warm disposable wipes.

It is another object of the present invention to provide a container for supplying warm wipes which employs a more effective method and system for activating the heat source therein.

A further object of the invention is to provide a container for supplying warm wipes which allows air to properly circulate within its chemical heat source and keep the chemical heat source separate from the wipes to be dispensed.

It is yet another object of the present invention to provide a convenient container for supplying warm disposable wipes wherein the container initially heats the first wipes to be dispensed by incorporating the heat source in more accessible parts of the container.

Still other objects and advantages of the invention will in part be obvious and will in part be apparent from the specification.

The above and other objects, which will be apparent to those skilled in the art, are achieved in the present invention which is directed to an apparatus for supplying warm wipes comprising a container having a compartment therein for holding a plurality of wipes and at least one pocket for holding a chemical heat pack therein. The pocket has a first surface in thermal contact with the compartment holding the wipes and a second surface having at least one opening therein in direct contact with the atmospheric air. The opening is of sufficient size to permit atmospheric air to circulate to the chemical heat pack in the pocket and cause an exothermic heat reaction to occur within the chemical heat pack and warm the wipes by transmitting heat through the pocket first surface. The pocket may be disposed on either the interior or exterior of a side, bottom or top of the container with a wall between the pocket and the container compartment.

The pocket may additionally include a slideable tray supported for movement into and out of the container so that the chemical heat pack may be placed in the tray when in the open position and be positioned inside the pocket after sliding the tray into its closed position. The compartment for the wipes may alternately be detachably connected to the portion of the apparatus containing the pocket for the chemical heat pack.

The pocket opening may be covered with a removable tab for initially sealing the chemical heat pack in an airtight pocket, the tab being removable from the opening to commence the exothermic reaction of the chemical heat pack.

The container may be a soft, resilient package with the pocket being secured to the top or bottom surface of the soft container. The soft, resilient package may alternately have a lid on the top surface with the pocket for the chemical heat pack being in the lid.

In another aspect, the present invention is directed to a method of supplying warm wipes. The method comprises providing a container having a compartment therein for holding a plurality of wipes and at least one pocket for holding a chemical heat pack therein. The pocket has a first surface in thermal contact with the compartment holding the wipes and a second surface having at least one opening therein in direct contact with the atmospheric air. The opening is of sufficient size to permit atmospheric air to circulate to the chemical heat pack in the pocket and cause an exothermic heat reaction to occur within the chemical heat pack and warm the wipes by transmitting heat through the pocket first surface. The pocket may be disposed on either the interior or exterior of a side, bottom or top of the container with a wall between the pocket and the container compartment. The method includes providing wipes inside the container compartment, providing a chemical heat pack inside the pocket, and exposing the chemical heat pack to atmospheric air through the opening to permit the atmospheric air to circulate to the chemical heat pack and cause an exothermic heat reaction to occur within the chemical heat pack, thereby warming the wipes by transmitting heat through the pocket first surface into the compartment for the wipes.

In still another aspect, the present invention is directed to an apparatus for supplying warm wipes comprising a container having a compartment therein for holding a plurality of wipes, the compartment having a dispensing lid hingedly attached to the compartment for movement between an open and a closed position. The container has at least one pocket for holding a chemical heat pack. The pocket has first pocket surface in thermal contact with the compartment holding the wipes and a second pocket surface hingedly attached to the container for movement between an open and a closed position. The second pocket surface has at least one opening in direct contact with the atmospheric air. The opening is of size sufficient to permit atmospheric air to circulate to the chemical heat pack in the pocket and cause an exothermic heat reaction to occur within the chemical heat pack, warming the wipes by transmitting heat through the second pocket surface.

In yet another aspect, the present invention is directed to an apparatus for supplying warm wipes comprising a flexible container having a compartment for holding a plurality of wipes. The compartment is formed between flexible first and second surfaces with a closure engagable along corresponding edges. The compartment is accessible, when the closure is in the unengaged position, for dispensing or inserting the wipes. The container additionally has at least one warming pocket for holding a chemical heat pack in the container. The pocket is formed between the first surface of the compartment holding the wipes and a flexible third surface with at least one opening. The opening is in direct contact with the atmosphere and is of a size sufficient to permit atmospheric air to circulate to a chemical heat pack in the pocket causing an exothermic heat reaction to occur within the chemical heat pack. The wipes are warmed by the chemical heat pack transmitting heat through the surface between the compartment and the pocket.

This aspect may be modified by adding a second pocket to the second surface of the compartment. The compartment closure may be removably adhesive double sided tape or a zipper.

In another aspect, the present invention is directed to an apparatus for supplying warm wipes comprising a container having a compartment for holding a plurality of wipes. The compartment is operable for dispensing or inserting the wipes. The container has at least one warming pocket for holding a chemical heat pack. The pocket has a first surface in thermal contact with the compartment holding the wipes and a flexible, porous second surface to permit atmospheric air to circulate to the chemical heat pack in the pocket through pores in the second surface. The atmospheric air circulation causes an exothermic heat reaction to occur within the chemical heat pack and the wipes are warmed by heat transmitting through the first surface to the compartment.

The compartment may be formed between a flexible third surface opposite the first surface. Alternately, a pleat may be included between the first and third surfaces so that the compartment is partially expandable to accept the wipes. The pocket may include an opening sized for the insertion or removal of the chemical heat pack and whereby the opening is inside the compartment.

In another aspect, the present invention is directed to a method of supplying warm wipes, the method comprising providing a container having a compartment therein for holding a plurality of wipes, the compartment having a dispensing lid hingedly attached to the compartment for movement between an open and a closed position. The container has at least one pocket for holding a chemical heat pack. The pocket has first pocket surface in thermal contact with the compartment holding the wipes and a second pocket surface hingedly attached to the container for movement between an open and a closed position. The second pocket surface has at least one opening in direct contact with the atmospheric air. The opening is of size sufficient to permit atmospheric air to circulate to the chemical heat pack in the pocket and cause an exothermic heat reaction to occur within the chemical heat pack, warming the wipes by transmitting heat through the second pocket surface. The method includes providing wipes inside the container compartment, providing a chemical heat pack inside the pocket, and exposing the chemical heat pack to atmospheric air through the opening to permit the atmospheric air to circulate to the chemical heat pack and cause an exothermic heat reaction to occur within the chemical heat pack, thereby warming the wipes by transmitting heat through the pocket first surface into the compartment for the wipes.

In still another aspect, the present invention is directed to a method of supplying warm wipes, the method comprising providing a flexible container having a compartment for holding a plurality of wipes. The compartment is formed between flexible first and second surfaces with a closure engagable along corresponding edges. The compartment is accessible, when the closure is in the unengaged position, for dispensing or inserting the wipes. The container additionally has at least one warming pocket for holding a chemical heat pack in the container. The pocket is formed between the first surface of the compartment holding the wipes and a flexible third surface with at least one opening. The opening is in direct contact with the atmosphere and is of a size sufficient to permit atmospheric air to circulate to a chemical heat pack in the pocket causing an exothermic heat reaction to occur within the chemical heat pack. The wipes are warmed by the chemical heat pack transmitting heat through the surface between the compartment and the pocket. The method includes providing wipes inside the container compartment, providing a chemical heat pack inside the pocket, and exposing the chemical heat pack to atmospheric air through the opening to permit the atmospheric air to circulate to the chemical heat pack and cause an exothermic heat reaction to occur within the chemical heat pack, thereby warming the wipes by transmitting heat through the pocket first surface into the compartment for the wipes.

This method may include providing a second warming pocket on the second surface of the compartment. It may also provide a zipper or removably adhesive double sided tape as the compartment closure.

In yet another aspect, the present invention is directed to a method of supplying warm wipes, the method comprising providing a container having a compartment for holding a plurality of wipes. The compartment is operable for dispensing or inserting the wipes. The container has at least one warming pocket for holding a chemical heat pack. The pocket has a first surface in thermal contact with the compartment holding the wipes and a flexible, porous second surface to permit atmospheric air to circulate to the chemical heat pack in the pocket through pores in the second surface. The atmospheric air circulation causes an exothermic heat reaction to occur within the chemical heat pack and the wipes are warmed by heat transmitting through the first surface to the compartment. The method includes providing wipes inside the container compartment, providing a chemical heat pack inside the pocket, and exposing the chemical heat pack to atmospheric air through the flexible, porous second surface to permit the atmospheric air to circulate to the chemical heat pack and cause an exothermic heat reaction to occur within the chemical heat pack, thereby warming the wipes by transmitting heat through the pocket first surface into the compartment for the wipes.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
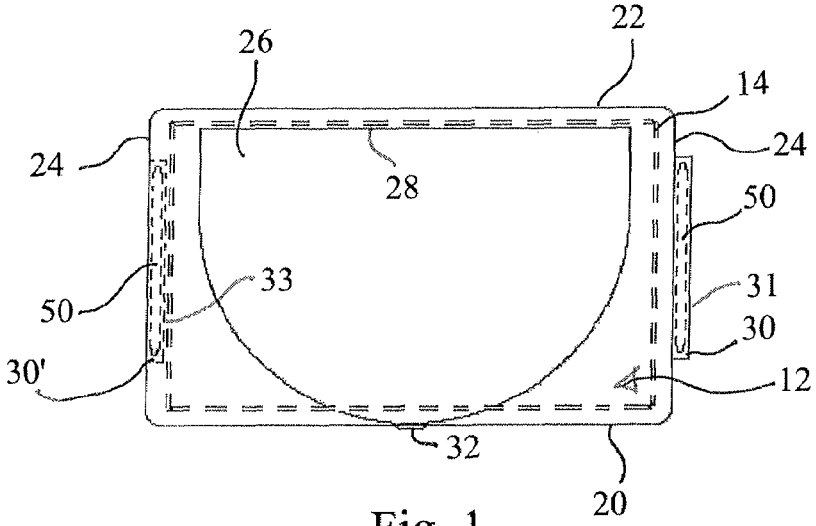
FIG. 1 is a top plan view of one embodiment of the container for warming disposable wipes in accordance with the present invention.

In describing the preferred embodiment of the present invention, reference will be made herein to FIGS. 1-14 of the drawings in which like numerals refer to like features of the invention.

FIGS. 1-4 show a first embodiment of the present invention which comprises a container 12 having six approximately rectangular sides in a box-like configuration to provide a compartment for holding a stack of moist wipes. The container is preferably constructed of a hard but resilient molded polymer and contains wipes 14 in an interior portion. The container has top surface 16 having a lid 26 thereon, a bottom surface 18 opposite the top surface, a front surface 20 connected along its top and bottom edges to the top surface and the bottom surface, respectively, a rear surface 22 opposite the front surface, and two side surfaces 24 on opposite ends of the container. The top and bottom surfaces are preferably sized slightly larger than wipes 14 to permit easy insertion to and removal from container 12. Lid 26 has a substantially straight edge molded in with the top surface 16 creating an integral hinge 28, with the remaining free edge portion being substantially semicircular in shape. As an alternate, lid 26 may have a permanent flexible hinge adhesively attached to the lid edge and the top surface 16. The lid may have any other desired configuration. The curved portion of the edge of the lid is removably sealed with the top surface by a lid tab 32 located along a portion of the curved edge tangent with the straight edge detachably fastening with a corresponding protruding slot 34 on the front surface 20. Wipes 14 stored within container 12 are readily accessible through lid 26. Such wipes may be wet, disposable personal wipes as described above, or any other type of wipes for which heating is desired.

In order to provide heat to the wipes in the container, one or more pockets are provided in or on the container with walls that are along the exterior of the container for one or more chemical heat packs, for example dry heat oxidation packs. Such dry heat oxidation packs are well known for warming a user's hands or feet in cold weather, and typically employ a composition that undergoes an exothermic reaction when exposed to oxygen in atmospheric air. The pack may be one of several commercially available heat packs, for example, containing iron powder, salt, water, activated carbon, and vermiculite. An exterior pocket 30 is shown disposed on the outer surface of the container 12 in thermal contact with the container interior through side surface 24. Although plastics such as used for the container may be considered to be thermal insulators, by making the wall relatively thin, a sufficient amount of heat from the dry heat oxidation pack in the pocket will flow into the interior of the container holding the wipes. The proper thickness of the wall separating the pocket and container interior may be determined without undue experimentation. An access slit 36 on the upper edge of the pocket permits insertion of a dry heat oxidation pack 50 into the interior of the pocket. Pocket 30 is attached to the outside wall of the container 12 with at least one and preferably a plurality of openings on the exterior wall of the pocket 31 directly accessing the atmosphere surrounding the container, here shown as substantially circular openings 40. These openings permit circulation of atmospheric air to the dry heat oxidation pack 50 in the pocket. The diameter of the openings may be between about 0.125 to 1.0 in. (3 to 25 mm), or such other size that allows for proper air contact to activate and warm the dry heat oxidation pack as it is disposed within the pocket.

Figure 2:
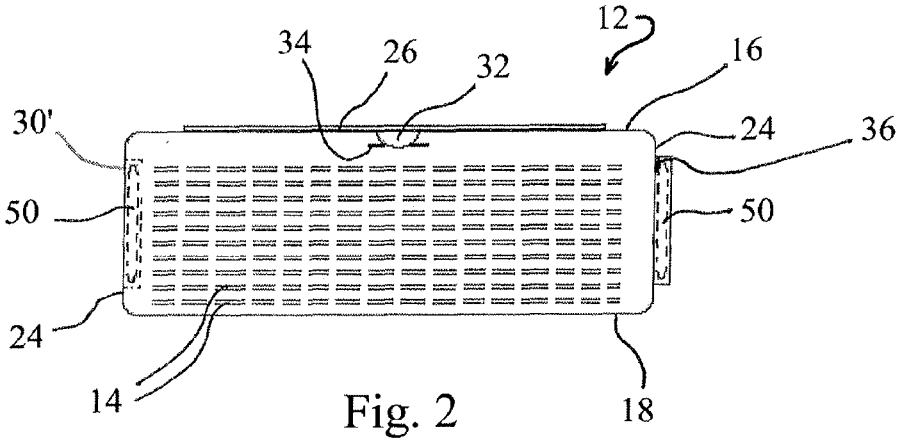
FIG. 2 is a front elevational view of the container shown in FIG. 1.
Figure 3:
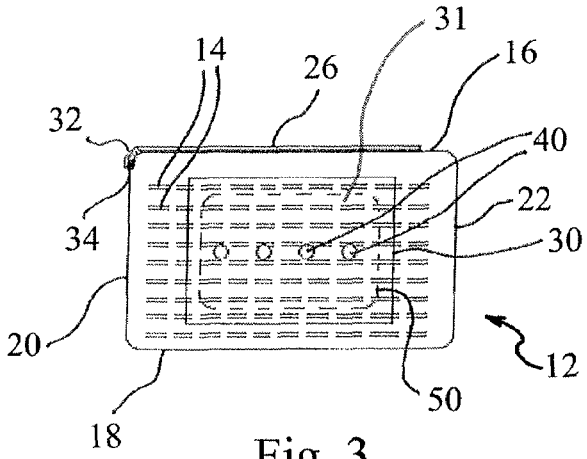
FIG. 3 is a right side elevational view of the container shown in FIG. 1.
Figure 4:
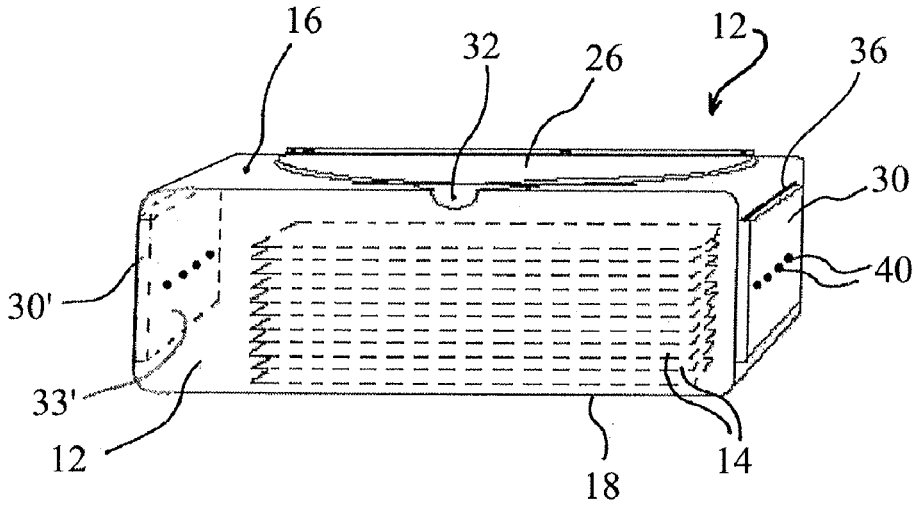
FIG. 4 is a perspective view of the container shown in FIG. 1.

The pocket may alternately be an internal pocket 30' within the side wall of the container as shown in phantom lines in FIGS. 1, 2 and 4. In an interior pocket, the access slit for the dry heat oxidation pack 50 may be accessible through the opened lid 26 on the top surface 16 or may be formed directly through top surface 16 near side 24. The openings 40 to the container exterior are formed in side surface 24, which itself forms the outer wall of the pocket, and the interior wall 33' of pocket 30' provides the thermal contact with the wipes in the container interior. While the drawing figures show the pockets 30 and 30' on the side ends 24 of the container, such pockets may be located on one or more of the other surfaces of container 12, either as internal or external pockets on the front, back, top or bottom surfaces. The number and placement of such pockets on the container is dependent on need for heat due to factors such as low ambient temperature, a lengthened time the warmed wipes are needed, or a large number of wipes in the container. While pockets 30 and 30' are shown sized to hold one dry heat oxidation pack, they may be enlarged to accommodate two or more of such packs.

During use of the invention, at least one dry heat oxidation pack 50 is exposed to the atmosphere and activated, optionally by shaking or squeezing, and placed in at least one of the pockets. The number of dry heat oxidation packs used at one time is a function of the amount of heat needed for a particular use. As the number of dry heat oxidation packs which are activated increases, the heating rate of the wipes increases and the warmer the wipes will become in a specific length of time. With a greater number of dry heat oxidation packs placed in a single pocket, a longer time of heat production is achieved, due to the fact that as dry heat oxidation packs are stacked on one another, reducing oxygen availability and thereby reducing the rate of heat-producing oxidation. This will allow the dry heat oxidation packs to generate at a minimal heat rate for a greater period of time.

Figure 5:
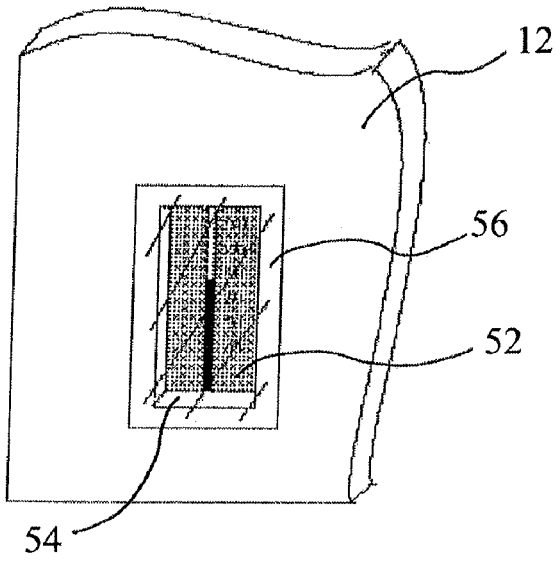
FIG. 5 is a perspective view of a temperature indicator used with the present invention.

FIG. 5 shows a temperature indicator 52 which may be attached to or incorporated integral with any of the surfaces of the container containing the wipes to allow the user to visually determine the temperature of the wipes. The temperature indicator 52 may be one of several currently available, such as those used on fish aquariums, that are substantially flat and have an adhesive backing in thermal contact with the wall to which it is adhered. The temperature indicator 52 is mounted on the interior of the container with a cutout portion 54 of the container permitting viewing of the temperature indicator and a thin transparent strip 56 on the exterior of the container over the cut out to protect the temperature indicator and provide thermal isolation from the atmospheric air.

Figure 6:
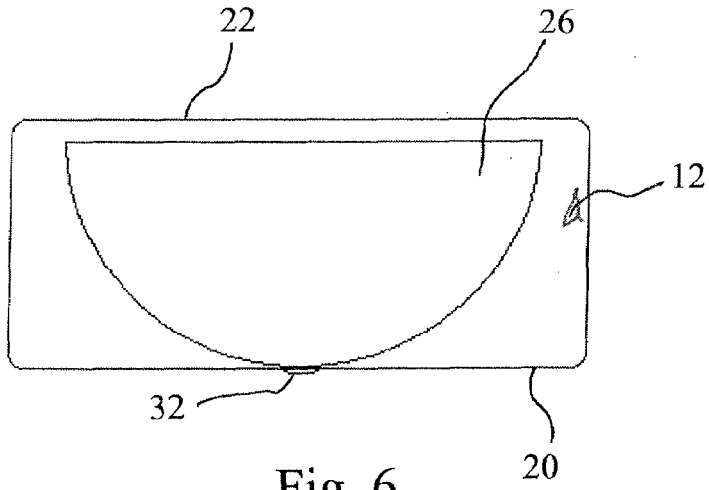
FIG. 6 is a top plan view of another embodiment of the warming wipes container in accordance with the present invention.
Figure 7:
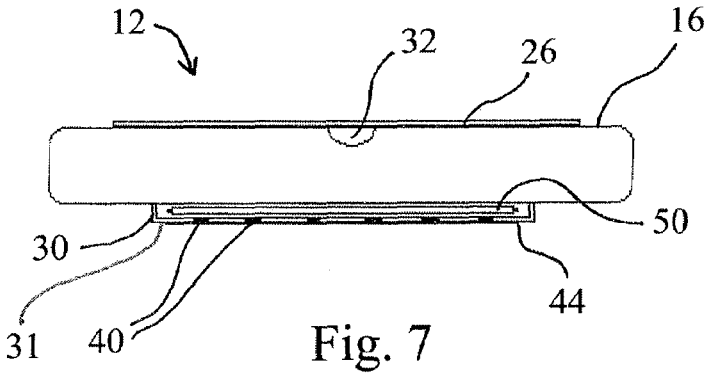
FIG. 7 is a front elevational view of the container shown in FIG. 6.
Figure 8:
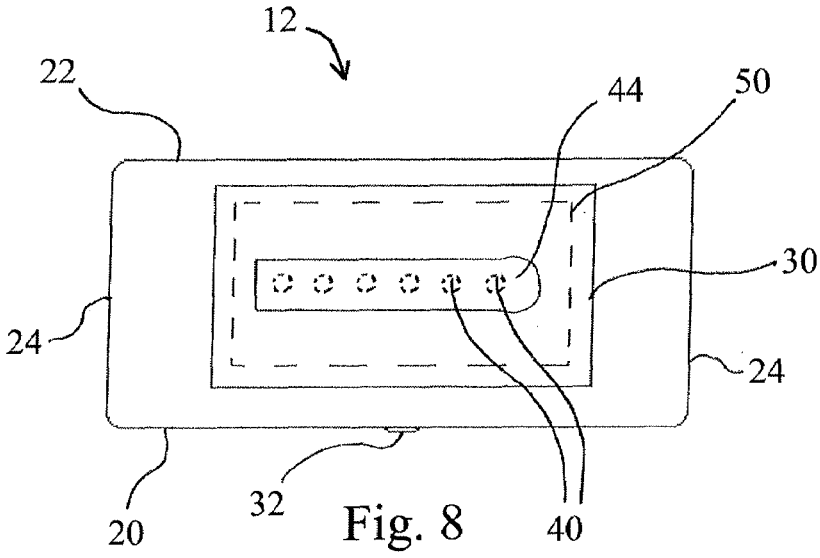
FIG. 8 is a bottom view of the container shown in FIG. 6.

FIGS. 6-8 depict another embodiment of the present invention which may be used as a compact version of the embodiment described above, as well as showing an alternate use of the dry heat oxidation pack 50 incorporated into the pocket 30 during manufacturing of the container. Container 12 has an interior compartment created by the walls for the wipe, which compartment is accessible through lid 26 as before. The wipes have been left out of the interior compartment for purposes of clarity, although they will typically be provided to the user within the container. The container 12 has external pocket 30 in thermal contact with bottom surface 18. At least one opening, and preferably multiple openings 40, are formed in the opposite exterior wall 31 of pocket 30. A removable activation tab 44 comprising a strip of adhesive tape on the exterior of the opposite wall initially covers openings 40. In this embodiment, dry heat oxidation pack 50 is provided in the pocket in an airtight environment prior to purchase by the user. When the user desires to warm the wipes, the user pulls the activation tab 44 from the pocket exterior wall 31 to remove the tape strip and expose openings 40, thereby allowing atmospheric air to circulate into the pocket and activating the oxidation process in the dry heat oxidation pack 50.

Figure 9:
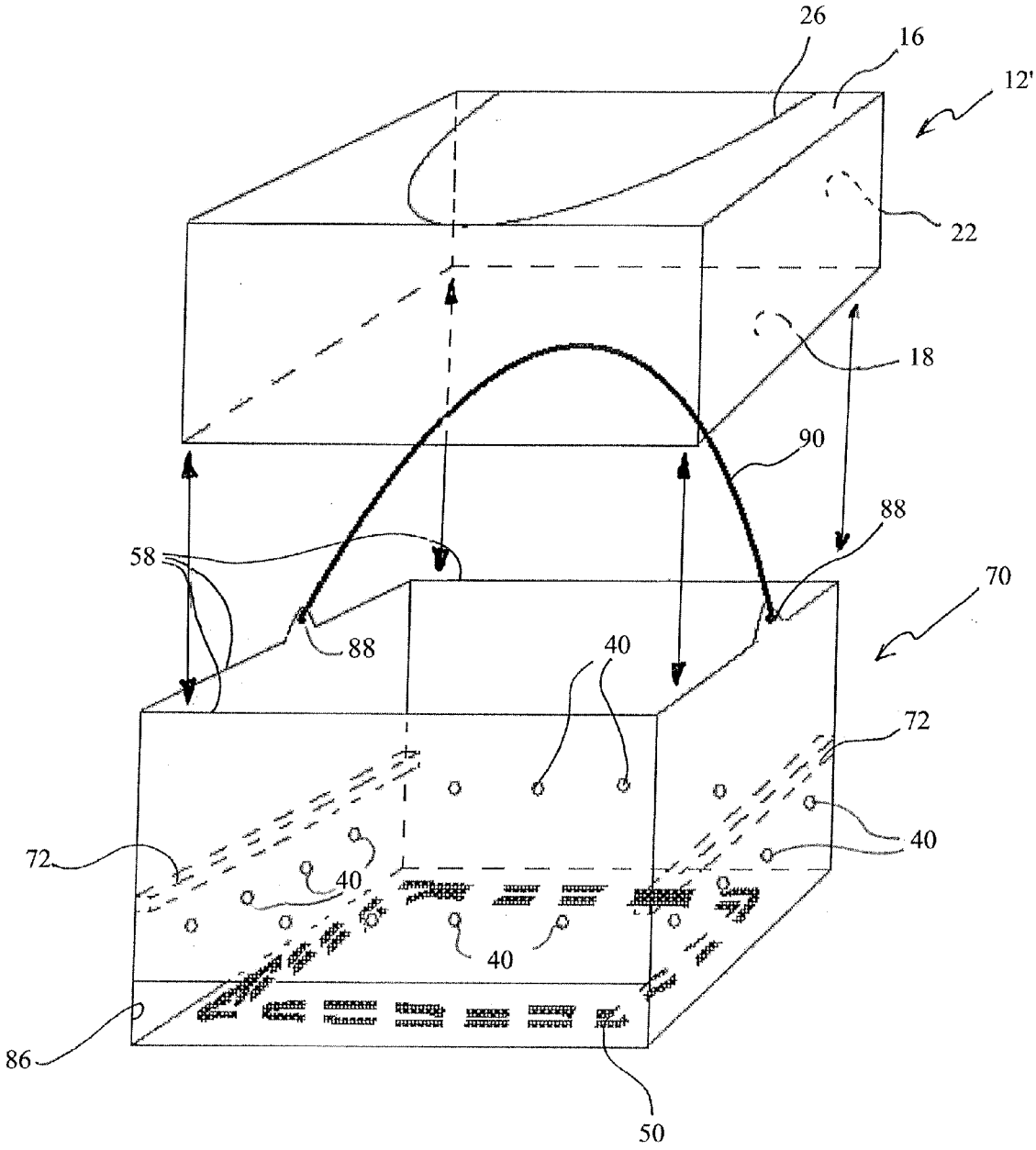
FIG. 9 is a perspective view of yet another embodiment of the warming wipes container in accordance with the present invention.

FIG. 9 shows another embodiment of the present invention in which the container 12' and the wipes therein (not shown) are detachably connected to and removable from a warmer 70. Wipes container 12' has an interior compartment for holding the wipes similar to the previous embodiment except that it has no dry heat oxidation pack pockets secured to or integral with the container walls or surfaces. Container 12' instead has a thin bottom surface such that heat generated below the surface may be efficiently transferred therethrough to any wipes in the container and has on its upper surface a snap cover with a molded hinge connecting the lid to the top surface. The wipes are initially placed in the container through the top lid 16, and the lid is resealed to make the interior of the container substantially air tight. Subsequently, container 12 containing the wipes is lowered into the open top of warmer 70.

Warmer 70 has a bottom and four rectangular sides 58 which correspond to the front, back, and side surfaces of the container, and have lateral dimensions minimally larger than those of container 12' to allow the container to slide down into the warmer 70. The container is lowered until the edges of the bottom thereon contact a set of at least two rails 72 permanently attached to or integral with at least two opposing interior sides 58 of the warmer. The rails located near the lower portion of the warmer sides 58 and leave sufficient space when the container is disposed thereon for at least one, and preferably a plurality of, dry heat oxidation packs 50 to be positioned below in the pocket formed by the container 12' bottom and the warmer 70 bottom. The dry heat oxidation pack may be inserted and removed through a slot opening 86 on one of the sides 58 of the warmer or, alternatively, be placed in the bottom of the warmer prior to the container being lowered therein. In the lower portion of the warmer below the rails there is at least one, and preferably a plurality of, openings 40 on one or more sides 58 of the warmer to allow atmospheric air circulation for the oxidation process of the dry heat oxidation pack. The number and size of the openings will depend on the rate of heating needed for warming the wipes. The warmer has clips 88 on the top edge of opposite sides in which a carrying strap 90 may be permanently or removably attached. In this embodiment, the container for the wipes and the warmer section are separate, and the warmer section may be reusable and configured to hold wipes containers currently available on the market. The user would simply dispose of the empty wipe container after the wipes are gone, and place another container of wipes into the warmer.

Figure 10:
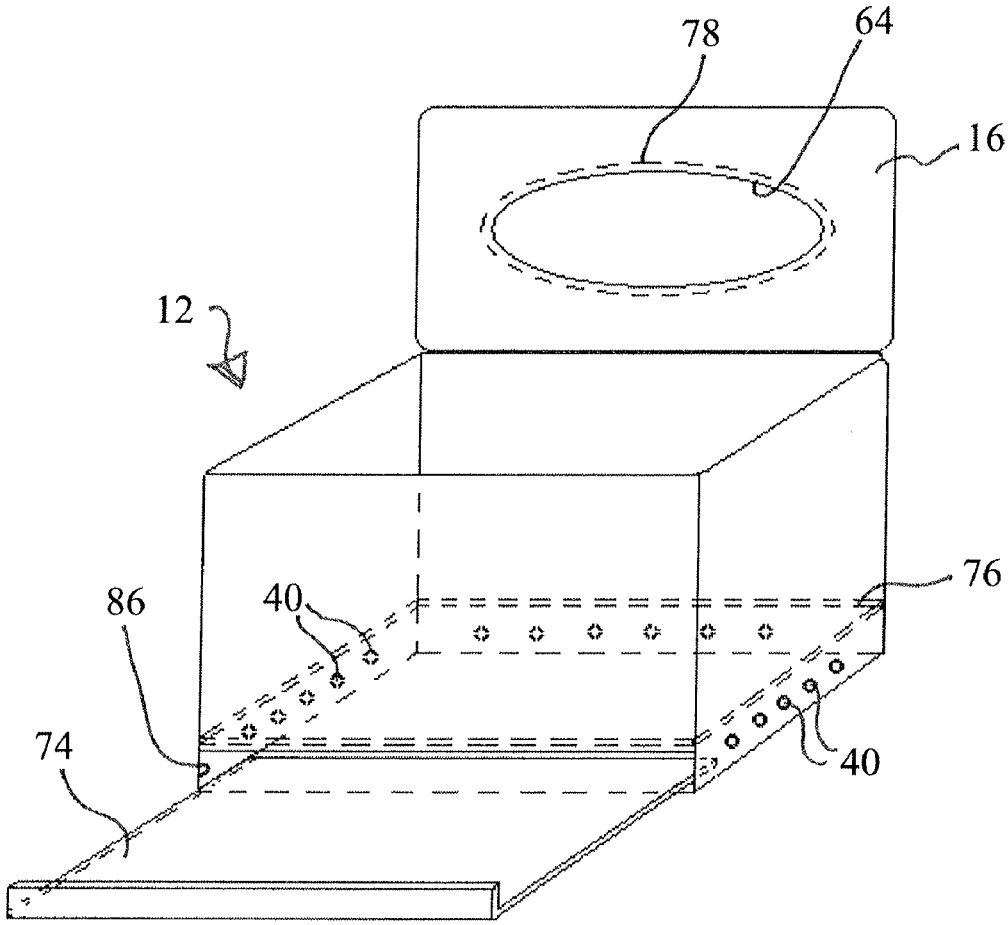
FIG. 10 is a perspective view of still a further embodiment of the warming wipes container in accordance with the present invention.

FIG. 10 shows a reusable embodiment of the present invention whereby a dry heat oxidation pack may be activated and placed in a pocket having a slidable tray 74 located in the lower portion of the container 12 containing the wipes. A divider 76 separates the tray region in the lower container portion from the upper portion of the container which comprises the compartment in which the wipes may be located. Divider 76 is preferably a thin sheet of thermally conductive material substantially parallel to and spaced above the bottom surface of the container. The wipes are supported by divider 76, with the divider allowing the heat generated by dry heat oxidation packs (not shown) on tray 74 to transfer to the upper compartment containing the wipes. The lid may be similar to that of previous embodiments or, as the alternative shown in FIG. 10, may have a snap top 78 removably sealed with an oval dispensing opening 64 for access of the wipes. The top surface may be hinged to the rear surface to allow container access for additional wipes to be placed inside the container. The rear surface and sides of the container have openings 40 as previously described located in the lower tray section of the container to allow atmospheric air circulation to continue the exothermic chemical reaction in the dry heat oxidation pack.

Figure 11:
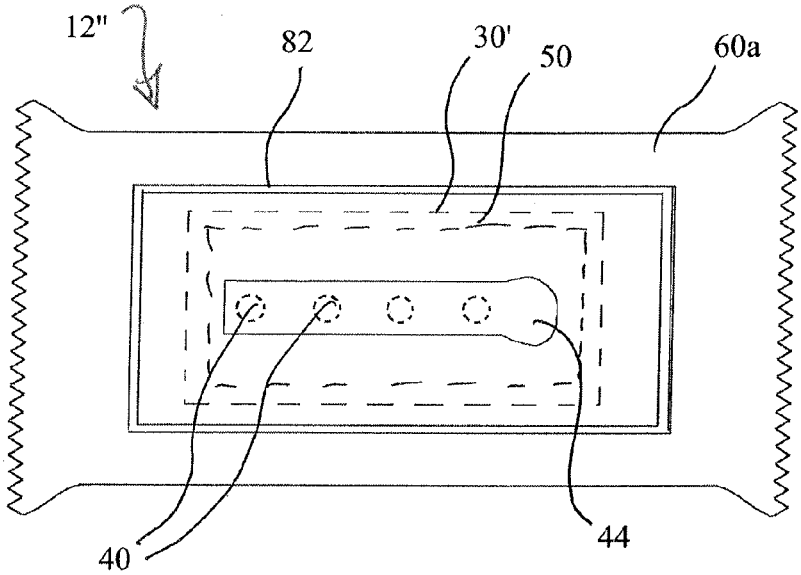
FIG. 11 is a top plan view of a soft pack embodiment of the warming wipes container in accordance with the present invention.
Figure 12:
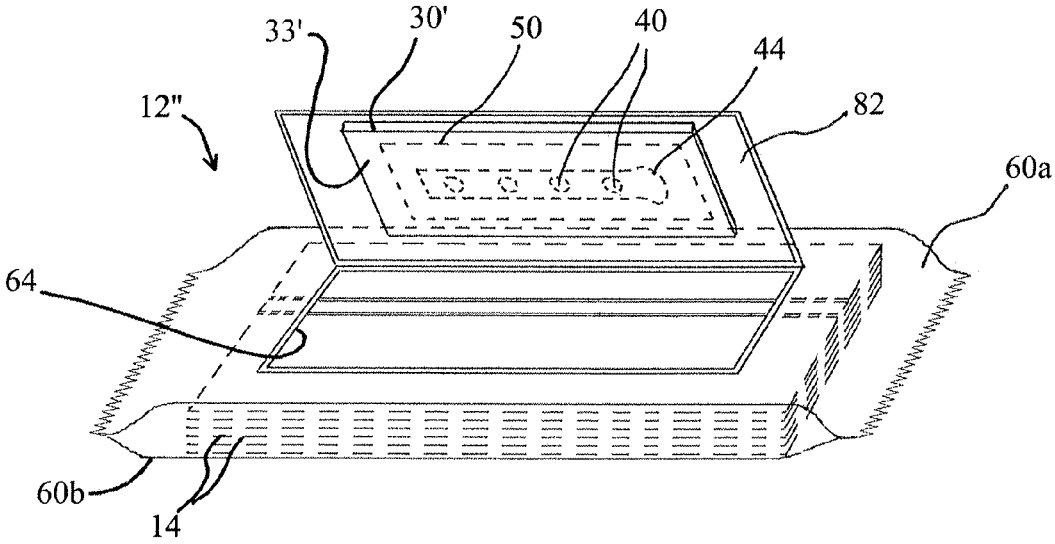
FIG. 12 is a perspective view of the container shown in FIG. 11

A disposable embodiment of the invention is shown in FIGS. 11 and 12. Container 12" is a soft pack made of a flexible plastic or foil upper and lower sides 60*a*, 60*b*, respectively, forming the compartment within which wipes 14 are held. The container has a stiff plastic lid 82 on the upper side 60*a* containing a pocket 30' on its interior surface for insertion and removal of a dry heat oxidation pack through a slot on the pocket side. The upper wall of the pocket has multiple openings 40 through lid 82, initially sealed with the activation tab 44, for circulation of atmospheric air once the tab is removed. Pocket 30' is in thermal contact with the wipes through lower wall 33' when the lid is in the closed position. One advantage of this embodiment is that, because of the soft side walls 60, container collapses down to the size of the stack of wipes 14 held therein, and the top wipe closest to the dispensing opening 64 is in direct contact with the thermally conductive wall 33' of the pocket, which permits the quick heating of the wipes to be used first.

Figure 13:
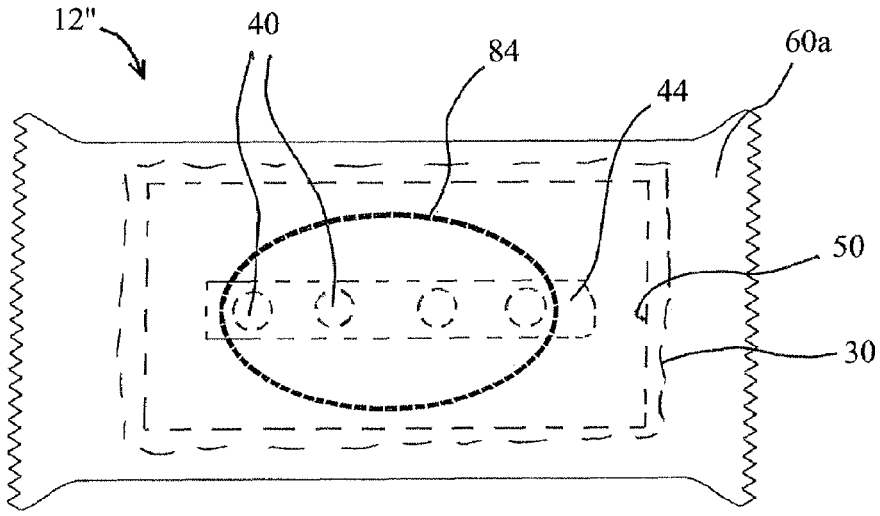
FIG. 13 is a top plan view of another soft pack embodiment of the warming wipes container in accordance with the present invention.
Figure 14:
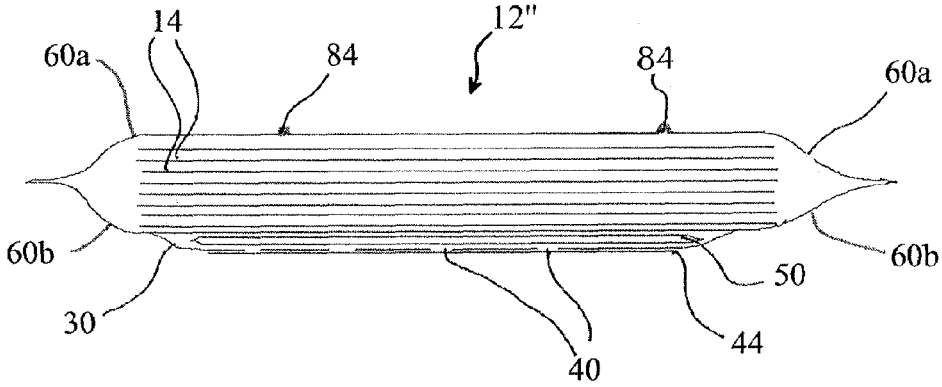
FIG. 14 is a front elevational view of the container shown in FIG. 13.

In FIGS. 13 and 14 the soft pack container 12" is shown, but with pocket 30 for the dry heat oxidation pack located on the opposite, bottom side 60*b* of the container. The dispensing of the wipes from the interior compartment may be via a lid on upper side 60*a* similar to lid 82 shown in FIGS. 11 and 12 (without the interior pocket and air openings). Alternatively a more economical version may have the dispensing opening created by pulling off a section of the upper surface 60*a* made with perforations 84 as shown in FIGS. 13 and 14.

Figure 15:
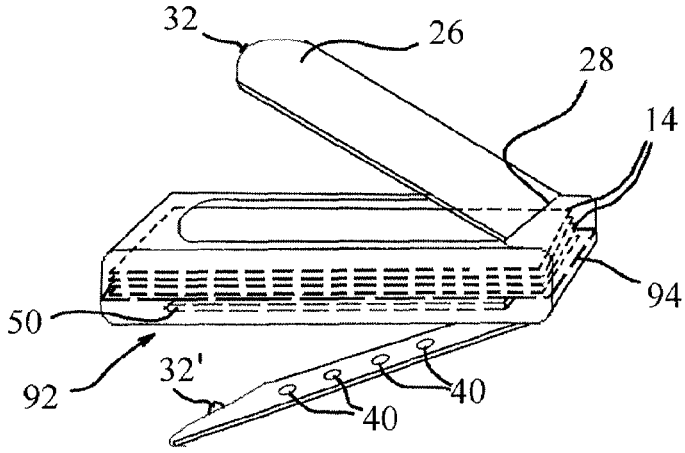
FIG. 15 is a perspective view of another embodiment of the container for warming disposable wipes in accordance with the present invention.
Figure 16:
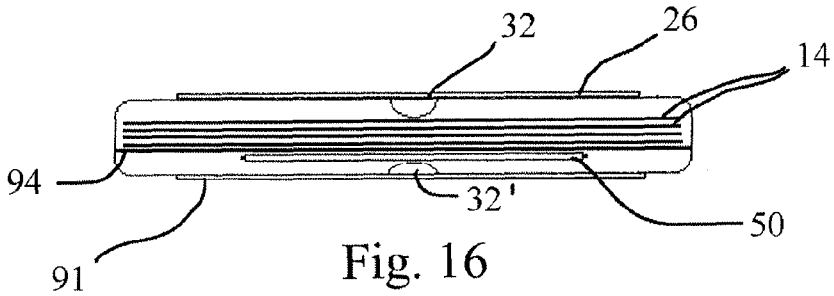
FIG. 16 is a front elevational view of the container shown in FIG. 15.
Figure 17:
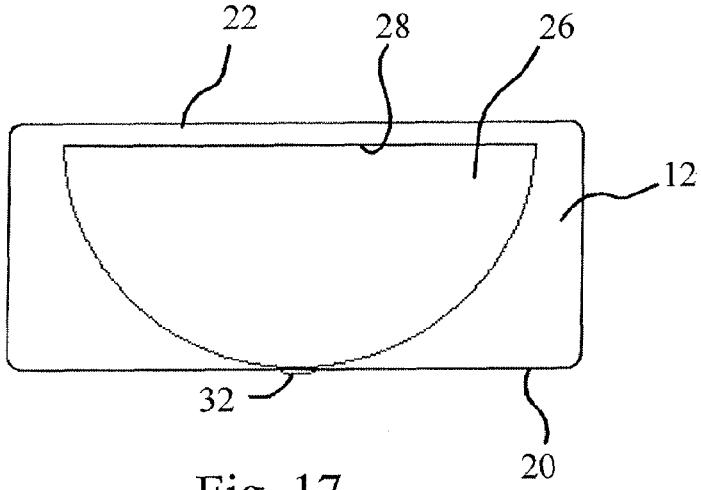
FIG. 17 is a top plan view of the container shown in FIG. 15.

In FIGS. 15-17, a warming container for wipes is shown which has a lid 26 on the top of the container 12 for accessing the wipes 14. The access to the dry heat oxidation pack 50 is through an access opening 92 in the bottom of the container covered and sealed with a bottom lid 91. In this embodiment of the invention, the lid 26 and bottom lid 91 may be attached to the container with a hinge 28, 28' along a first edge and secured in the closed position by a tab 32, 32' along a second edge, the tab securely contacting a point on the container surface. The hinge 28 allows the lid 26 to swing to an open position by pulling the tab 32 from the secured position and lifting the lid. In the same way, the bottom lid 91 is hingedly attached to the container for movement between an open and a closed position and has a tab 32' for securing the bottom lid in the closed position. The portion of the container for holding and dispensing the wipes at the top of the container is separated from the portion of the container for holding the dry heat oxidation pack by a wall or surface 94 able to thermally transmit heat from the chemical heat pack 50 to the wipes 14. The bottom lid 91 has at least one opening 40 in direct contact with the atmospheric air. The opening, or the plurality of openings, are of a size sufficient to permit the atmospheric air to circulate to the portion of the container containing the chemical heat pack, allowing for the exothermic reaction to take place in the dry heat oxidation pack. The chemical heat pack preferably is a dry heat oxidation pack. The materials used for the container in this embodiment are preferably a hard plastic, although other materials may be employed, including soft plastics.

Figure 18:
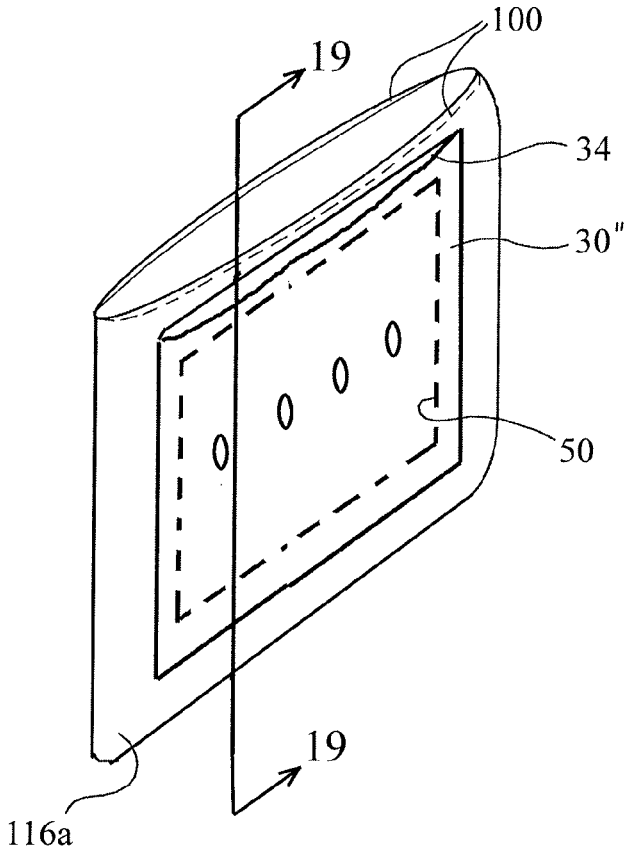
FIG. 18 is a perspective view of a fabric container for warming disposable wipes in accordance with the present invention
Figure 19:
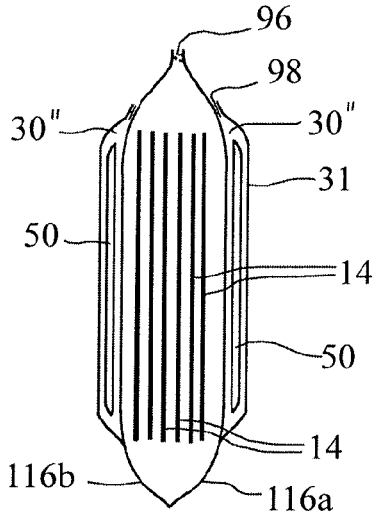
FIG. 19 is a cross sectional view of the container in FIG. 18.

FIGS. 18 and 19 show an embodiment of the invention where the compartment for storing the wipes has two flexible or resilient surfaces 116*a*, 116*b*, made of a soft flexible plastic or fabric, which are attached along the majority of each edge surface, except for a portion 100 along corresponding edges where that portion may be separated for dispensing the wipes. This configuration may resemble a small purse where the two flexible surfaces 116*a*, 116*b* may shape themselves to the items in the compartment. The separable portion may be releasably secured together with a closure 96 having engagable strips such as a zipper or removably adhesive double-sided tape, making the compartment operable for the dispensing or inserting of the wipes when the closure is in the unengaged position. A pocket 30" for holding the dry heat oxidation pack 50 may be disposed against at least one of the compartment surfaces 116*a*, 116*b*, where the compartment surface transmits the heat from the chemical heat pack in the pocket to the wipes in the container. The compartment surface 116*a*, 116*b* transmitting the heat is the surface located between the compartment and the pocket. Preferably, the pocket 30" is disposed on each of the two walls or surfaces 116*a*, 116*b* of the compartment. The pocket has an exterior wall or surface 31 having at least one opening 40 to allow the atmospheric air to circulate to the dry heat oxidation pack 50 disposed in the pocket 30". The exterior surface 31 of the pocket is attached to the compartment surface 116*a*, 116*b* along the corresponding edges except for a portion of the exterior surface edge 34 large enough to insert and remove the dry heat oxidation pack 50 into and out of the pocket. The portion of the edge 34 not permanently attached to the compartment may be removably attached to the surface of the compartment with removably adhesive double-sided tape 98, or alternately, any other fastener which allows re-sealable access to the pocket.

Figure 20:
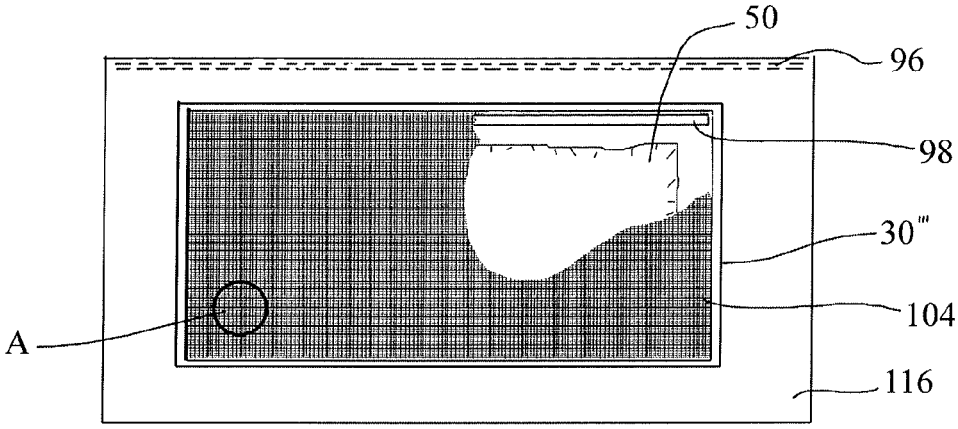
FIG. 20 is a side elevational view showing another embodiment of the fabric container for warming disposable wipes according to the present invention.
Figure 21:
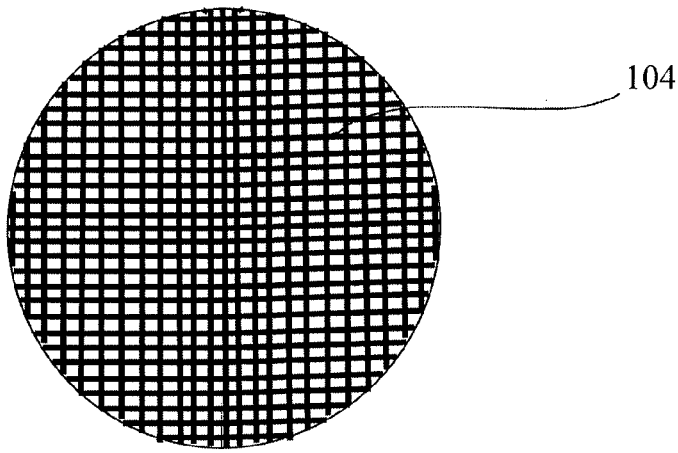
FIG. 21 is an enlarged view of a portion of the embodiment shown in FIG. 20.

FIG. 20 shows an alternate embodiment of the invention discussed above. The pocket exterior surface 104 may be porous, preferably flexible and porous, such as a woven textile fabric as shown in an enlarged view of A in FIG. 21. This feature eliminates the requirement to have larger openings in the surface since the porosity of the exterior surface allows atmospheric air to circulate to the dry heat oxidation pack 50 within the pocket 30'", allowing for a exothermic reaction to take place in the dry heat oxidation pack. The heat is then transmitted through the compartment surface 116 along which the dry heat oxidation pack is in contact with, into the compartment containing the wipes 14.

Figure 22:
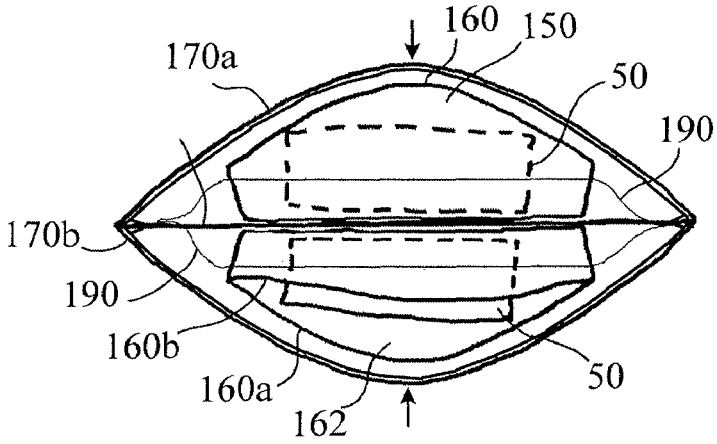
FIG. 22 is a top plan view of yet another embodiment of the fabric container for warming disposable wipes according to the present invention.
Figure 23:
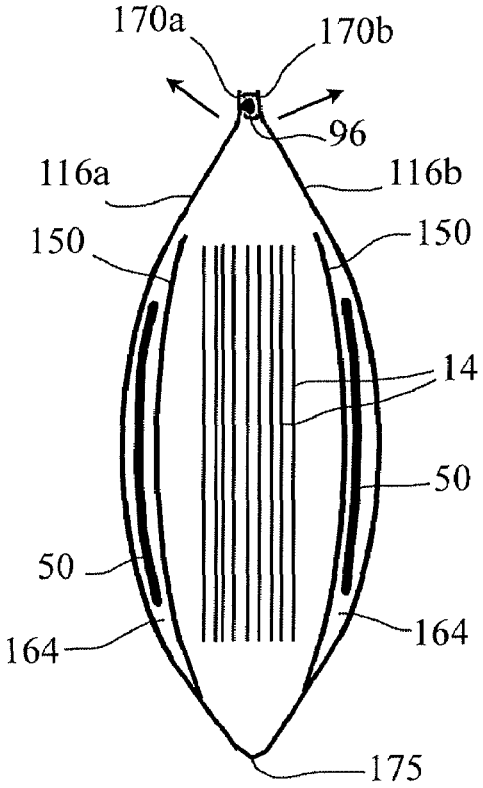
FIG. 23 is a cross-sectional view of the fabric container shown in FIG. 22.

In another embodiment of the present invention, the compartment for storing the wipes has two flexible or resilient surfaces 116*a*, 116*b*, made of a soft flexible plastic or fabric as shown in FIGS. 22-23. The compartment surfaces 116*a*, 116*b* are secured to each other with seams along the majority of each edge surface, except for a portion along corresponding top edges 170*a*, 170*b* which are separably attached for dispensing the wipes. Top edges 170*a*, 170*b* may be releasably secured together with a closure 96 having engagable strips such as a zipper or removably adhesive double-sided tape, making the compartment operable for the dispensing or inserting of the wipes when the closure is in the unengaged position. A bottom seam 175 is visible when the compartment is in the open position. The wipes or a package of wipes are shown in phantom lines 190 of FIG. 22, with arrows indicating the direction of movement of the top edges 170*a*, 170*b* for closure of the compartment. FIG. 23 shows another view of the bottom seam when the compartment is in the closed position, the arrows indicating the direction of movement of the top edges 170*a*, 170*b* to open the compartment. An interior pocket 164 for holding the dry heat oxidation pack 50 is disposed against the inside face 162 of each of the compartment surface 116*a*, 116*b*. The interior pocket 164 includes the inside face 162 on which the interior pocket is disposed and an interior pocket wall 150. The interior pocket wall 150 is attached to the compartment surface 116*a* or 116*b* along the edge of the interior pocket wall 150 except a portion of the edge sized to allow insertion of the dry heat oxidation pack into the interior pocket 164. The compartment surfaces 116*a*, 116*b* are porous, preferably flexible and porous, such as a woven textile fabric. The porosity allows atmospheric air to circulate to the dry heat oxidation pack 50 within the pocket, allowing for a exothermic reaction to take place in the dry heat oxidation pack. The pocket shown in an open position in FIG. 22 for accessing the dry heat oxidation pack with interior pocket wall 150'. The interior pocket wall 150 transmits the heat from the chemical heat pack in the pocket to the wipes 14 in the container. The pocket has a top edge 160, wherein the top edge 160*a* of the interior pocket wail 150 corresponds with a line 160*b* on the compartment inside face 62 such that the top edge 160*a* may be removably attached along the line 160*b* for insertion and removal of the dry heat oxidation pack. This embodiment of the invention has the dry heat oxidation pack within the compartment surfaces 116*a*, 116*b*. The compartment top edges 170*a*, 170*b* must be in the open position to access the dry heat oxidation pack.

Figure 24:
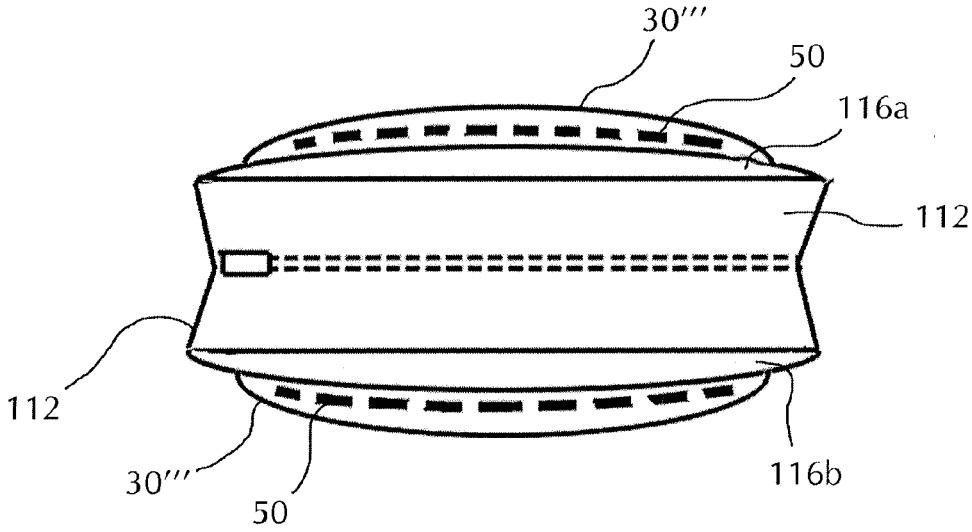
FIG. 24 is a top plan view of still another embodiment of the fabric container for warming disposable wipes according to the present invention.
Figure 25:
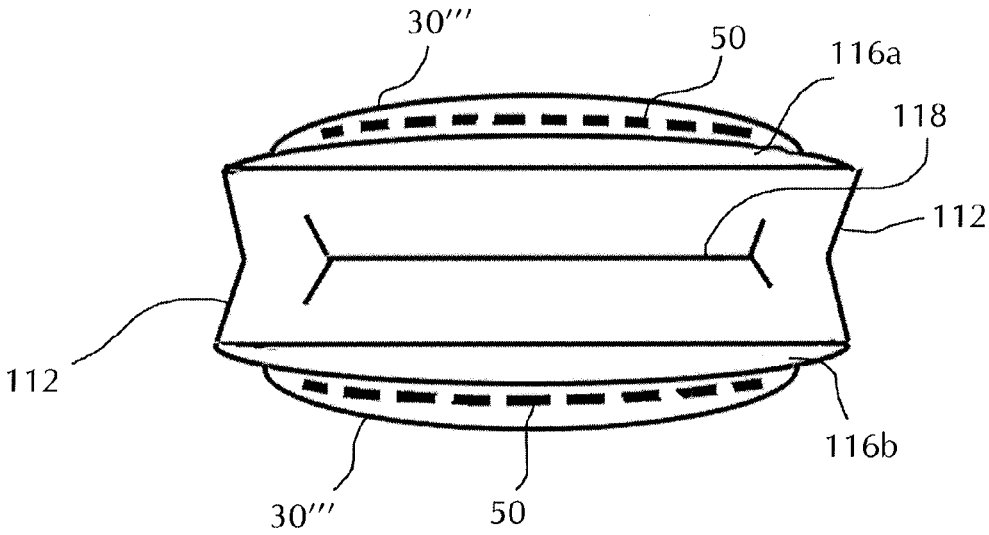
FIG. 25 is a bottom view of the container shown in FIG. 24.

In another embodiment (FIGS. 24 and 25), the edges of the corresponding compartment surface are separated by a flexible, resilient plastic or fabric expandable material 112 having a pleat 118 attached between the corresponding edges of the compartment in order to allow for additional expansion of the compartment interior. The compartment of this embodiment will resemble a gusset bag as depicted in the top and bottom views of the embodiment of the present invention. The pocket exterior surface 30''' may have openings of a size sufficient to allow atmospheric air to circulate into the pocket and cause an exothermic reaction in the dry heat oxidation pack. Alternately, the pocket exterior surface 30''' may have a porous structure as in FIG. 21, resulting in the exothermic reaction in the dry heat oxidation pack placed therein.

Figure 26:
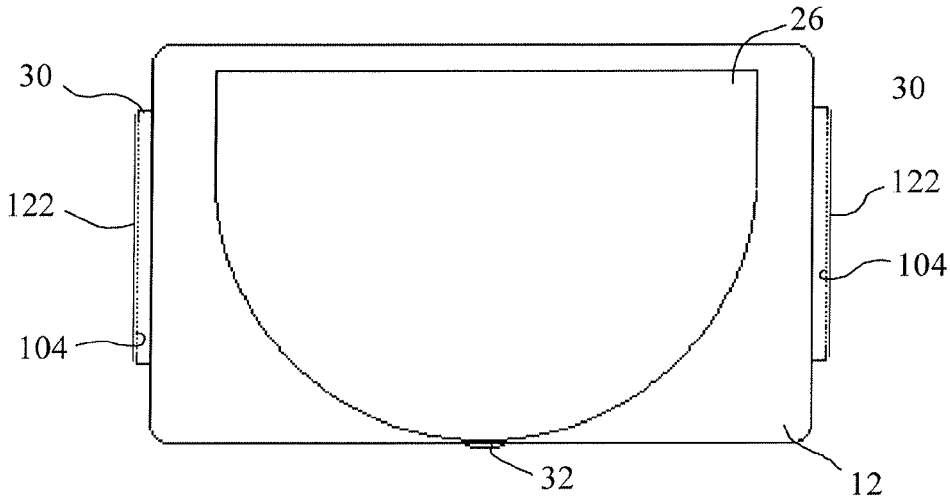
FIG. 26 is a top plan view of yet another embodiment of the container for warming disposable wipes according to the present invention.
Figure 27:
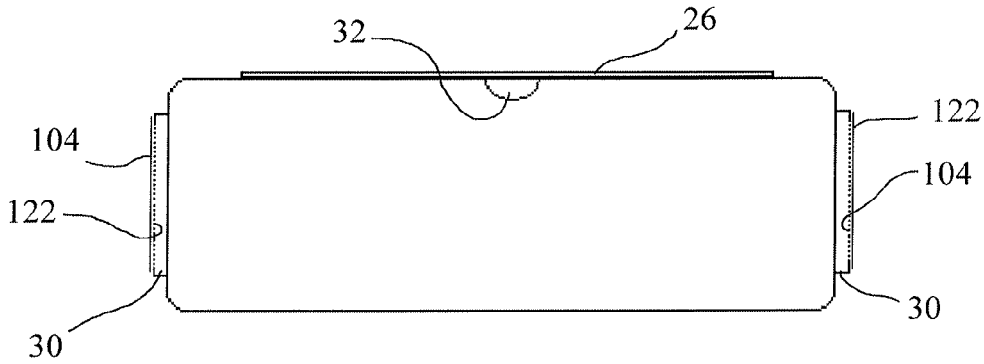
FIG. 27 is a front elevational view of the container shown in FIG. 26.
Figure 28:
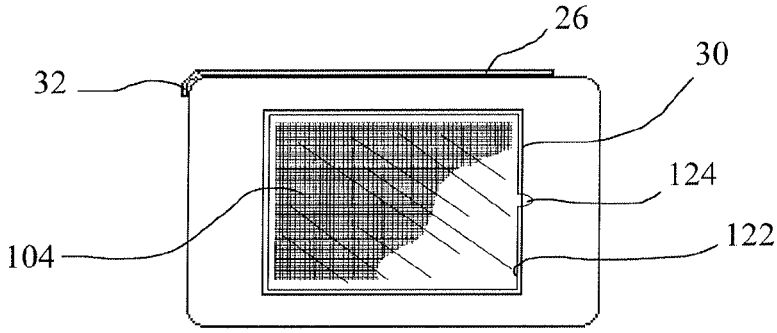
FIG. 28 is a side elevational view of the container shown in FIG. 26.

FIGS. 26-28 show an embodiment of the present invention which combines a rigid container 12 for storing and dispensing the wipes with at least one pocket 30 having a porous exterior surface 104 sufficient for allowing circulation of atmospheric air for producing an exothermic reaction in the dry heat oxidation pack 50 within the pocket 30. The pocket may be disposed on any surface of the compartment as well as being disposed on multiple surfaces. The rigid compartment also has a hinged or completely removable lid 26 for dispensing the wipes, and a tab 32 for securing the lid in a closed position.

In any of the embodiments of the present invention having a pocket with a porous exterior surface, there may be an air impermeable cover 122 initially disposed sealably over the porous portion of the exterior surface of the pocket to keep the dry heat oxidation pack from atmospheric air exposure prior to use. Removing the cover will commence the exothermic reaction of the dry heat oxidation pack. An example of the cover 122 is shown on the embodiment of the present invention in FIGS. 26-28. The cover 122 may additionally include a cover tab 124 to aid in grasping the cover for removal.

The dry heat oxidation pack may be made part of the containers and apparatus described herein during manufacturing and may be made replaceable or, alternately, be provided by the user. One commercially available dry heat organic oxidation pack which may be used is HotHands® produced by Heatmax, Inc. of Dalton, Ga. Where the user provides the dry heat oxidation pack, the package would have its exterior protective packaging removed to commence the activation of the heat production process. The dry heat oxidation pack would typically be a package containing the combination of iron powder, salt, water, activated carbon, and vermiculite. This combination, when exposed to the air, produces an exothermic reaction through oxidation. Typically available heat packs generate heat for about 2-8 hours. Since the rate at which heat is produced is a function of the rate at which oxygen is supplied to the reaction, limiting the amount of air allowed to contact a dry heat oxidation pack would restrict the amount of heat produced.

Although some of the previous embodiments have been described on the basis that the invention is refillable either with dry heat oxidation packs made specifically for the invention or with presently available dry heat oxidation packs, any of the embodiments may be a one-time-use disposable container of warming wipes that have the wipes and the dry heat oxidation packs built into the container. The warming of the wipes may be then commenced by pulling out the activation tab covering the openings of the pockets, or alternately removing a cellophane covering, or snapping a breakable vial within the dry heat oxidation pack to allow the chemicals to combine and react. If there are more wipes in the container that are typically used in one application, a plurality of pockets containing the dry heat oxidation packs would allow the invention to be used several times if less than all of the dry heat oxidation packs are activated in one use.

The wipes also entail several embodiments which include but are not limited to their size, various compositions incorporated in the wipes such as scents, lotions, antimicrobial agents, and designs on the wipes to appeal to different users such as fish or animals for the hunter/fisherman, infant designs for caretakers, and floral designs for general use. An antimicrobial sponge may also be provided with the wipes in the container to impede the growth of bacteria or fungus.

Thus, the present invention provides a container for supplying warm wipes which employs a more effective method and system for activating the heat source therein, particularly with dry heat oxidation packs. The container allows air to properly circulate within its chemical heat source and keep the chemical heat source separate from the wipes to be dispensed. The container is able to initially heat the first wipes to be dispensed by incorporating the heat source in more accessible parts of the container.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

What is claimed is:

1. An apparatus for supplying warm wipes comprising:

a container having a compartment therein for holding a plurality of wipes, the compartment having a dispensing lid hingedly attached to the compartment for movement between an open and a closed position;

at least one pocket for holding a chemical heat pack in the container, the at least one pocket having a first pocket surface in thermal contact with the compartment holding the wipes and a second pocket surface hingedly attached to the container for movement between an open and a closed position, the second pocket surface having at least one opening therein in direct contact with the atmospheric air, the at least one opening being of size sufficient to permit atmospheric air to circulate to the chemical heat pack in the pocket and cause an exothermic heat reaction to occur within the chemical heat pack and warm the wipes by transmitting heat through the first pocket surface; and an air impermeable cover sealably disposed over the at least one opening of the second pocket surface to keep a chemical heat pack in the pocket from exposure to the atmospheric air prior to use, the air impermeable cover having a tab to aid in grasping the cover, wherein by grasping the air impermeable cover tab, pulling away from the second pocket surface and removing the air impermeable cover from the at least one opening of the second pocket surface, the chemical heat pack is exposed to the atmospheric air through the at least one opening.

2. A method of supplying warm wipes comprising:

providing a container having a compartment therein for holding a plurality of wipes, the compartment having a dispensing lid hingedly attached to the compartment for movement between an open and a closed position and at least one pocket for holding a chemical heat pack in the container, the at least one pocket having a first pocket surface in thermal contact with the compartment holding the wipes and a second pocket surface hingedly attached to the container for movement between an open and a closed position, the second pocket surface having at least one opening therein in direct contact with the atmospheric air, the at least one opening being of size sufficient to permit atmospheric air to circulate to the chemical heat pack in the pocket and cause an exothermic heat reaction to occur within the chemical heat pack and warm the wipes by transmitting heat through the first pocket surface, and an air impermeable cover sealably disposed over the at least one opening of the second pocket surface to keep the chemical heat pack in the pocket from exposure to the atmospheric air prior to use, the air impermeable cover having a tab to aid in grasping the air impermeable cover;

providing wipes inside the container compartment;

providing a chemical heat pack inside the at least one pocket;

grasping the cover tab and pulling away from the second pocket surface to remove the air impermeable cover from the at least one opening of the second pocket surface; and exposing the chemical heat pack to atmospheric air through the at least one opening to permit atmospheric air to circulate to the chemical heat pack in the pocket and cause an exothermic heat reaction to occur within the chemical heat pack, thereby warming the wipes by transmitting heat through the pocket first surface into the compartment for the wipes.

3. The method of claim 2 wherein the air impermeable cover is completely removed from the second pocket surface.

4. The apparatus of claim 1 wherein the air impermeable cover is completely removable from the second pocket surface.

* * * * *